United States Patent [19]

Brokmann

[11] Patent Number: 4,541,150

[45] Date of Patent: Sep. 17, 1985

[54] CONNECTION FOR STRAP

[76] Inventor: Manfred Brokmann, Silcherstrasse 5, 4500 Osnabrück, Fed. Rep. of Germany

[21] Appl. No.: 536,413

[22] Filed: Sep. 27, 1983

[30] Foreign Application Priority Data

Oct. 7, 1982 [DE] Fed. Rep. of Germany ..... 3237124

[51] Int. Cl.[4] ..... A44C 5/18; A47H 13/00

[52] U.S. Cl. ..... 24/265 C; 24/563; 160/404

[58] Field of Search ..... 24/265 C, 563, 545, 24/562, 265 CC, 71.1, 71.3, 72.5, 72.7; 160/402, 404, D15

[56] References Cited

U.S. PATENT DOCUMENTS

| | | | |
|---|---|---|---|
| 2,582,579 | 1/1952 | Bedford, Jr. | 24/265 C |
| 2,979,119 | 4/1961 | Kramer . | |
| 3,042,113 | 7/1962 | Kramer | 160/404 |
| 3,088,517 | 5/1963 | Schwartz et al. | 24/265 C |
| 3,167,836 | 2/1965 | Walter | 24/265 C |
| 3,263,294 | 8/1966 | Pappas | 24/265 C |
| 3,438,099 | 4/1969 | Green | 24/265 C |
| 3,464,479 | 9/1969 | Baker | 24/265 C |
| 3,910,339 | 10/1975 | Kramer | 24/265 C |
| 3,960,197 | 6/1976 | Daniels | 160/404 |
| 4,280,548 | 7/1981 | Brokmann et al. . | |

FOREIGN PATENT DOCUMENTS

| | | |
|---|---|---|
| 565221 | 11/1944 | United Kingdom . |
| 800828 | 9/1958 | United Kingdom . |
| 964853 | 7/1964 | United Kingdom . |

*Primary Examiner*—Victor N. Sakran

*Attorney, Agent, or Firm*—Jordan and Hamburg; Jordan and Hamburg

[57] ABSTRACT

A connection for connecting a strap to a frame member of an article of furniture includes a body member adapted to be disposed adjacent to the frame member, the body member having a first surface and a second surface, the strap passing over the first surface, around at least a portion of the frame member, and onto at least a portion of the second surface such that the strap has a loop disposition extending at least partially around the frame member and the body member. A connecting member is disposed over the first surface such that a portion of the strap is located between the connecting member and the body member. A securing arrangement on the connecting member and on the body member secures the connecting member to the body member, the securing means including a projecting portion on the connecting member and a receiving portion on the body member, the strap having an opening through which the projecting portion passes, whereby the strap is adapted to be initially placed in the aforementioned loop disposition extending at least partially around the frame member and the body member and subsequently secured as the projecting portion of the connecting member is received in the receiving portion of the body member.

21 Claims, 8 Drawing Figures

CONNECTION FOR STRAP

BACKGROUND OF THE INVENTION

This invention relates to a strap connection and particularly to a covering strap connection for furniture.

In a known strap of this type, the upper part of a connecting device is shaped as a slide clasp having locking parts which project laterally in a downward direction. The lower part of the connecting device consists of a transverse pin which is connected to the strap end in the area of the lateral edge and which has projecting ends extending across the width of the strap end which are lockable in the locking recesses in the clasp handles by snap locking.

This type of strap, generally having such a connecting device at each strap end, can be attached to the opposite member of the frame of a piece of furniture without the member having to have borings, slits, or similar recess means. Since straps serving as covering straps for furniture have to be affixed between the members of the frame and the piece of furniture with a certain longitudinal strap tension in order to prevent light sagging of the straps and to produce a certain elastic effect of the strap cover, the affixing of the second strap end following the affixing of the first strap end causes certain difficulties, since the connection between the upper and the lower part of the connecting device is complicated by the desired longitudinal strap tension. This is especially true in the case of lrge longitudinal strap tension when the affixing of the second strap end to the member requires a tool or an auxiliary device, thereby increasing the time consumed as well as the costs of the strap mounting. Furthermore, the strap piece is exposed to relatively high stress in those areas where the parts of the mounting device affect the strap piece so that the strap piece has to have considerable additional strength of its own in order to tolerate such strain, the strain being higher in certain areas. Finally, there is a certain element of uncertainty as to achieving an even and consistently even longitudinal strap tension, since the strap loop surrounding the members tightens more or less under strain, resulting in a possible stretching of the free part of the strap piece between the members of the frame of the piece of furniture.

Accordingly, it is the object of the invention to produce a strap which can be easily affixed to the members of the frame of a piece of furniture, even under considerable longitudinal strap tension, and which essentially maintains its longitudinal strap tension when in an affixed position and when the piece of furniture is being used, and which can additionally be manufactured at a low price.

The design of the lower part of the connecting device for the strap in the invention is in the form of a filling piece for the loop wedge of the strap loop spanning around the member of the frame of the piece of furniture and which not only provides the strap piece in the loop with a precisely defined course, but which also forms a lever with which the part of the strap end, which is placed around the member, can be pushed by hand in the connection area while producing the desired longitudinal strap tension, and which can be easily maintained in this position until the upper part of the connecting device has been brought together with the lower part into the locking action. Thus, there is no need for a clamping tool or a corresponding auxiliary device, and the mounting time can be reduced as well, which influences the costs for the strap itself as well as the costs for the furniture covering. The strap itself can be produced at a very low cost while the design of the connecting device lowers the strain on the strap piece in the connection area and at the same time precludes pieces, that project over the width of the strap piece.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
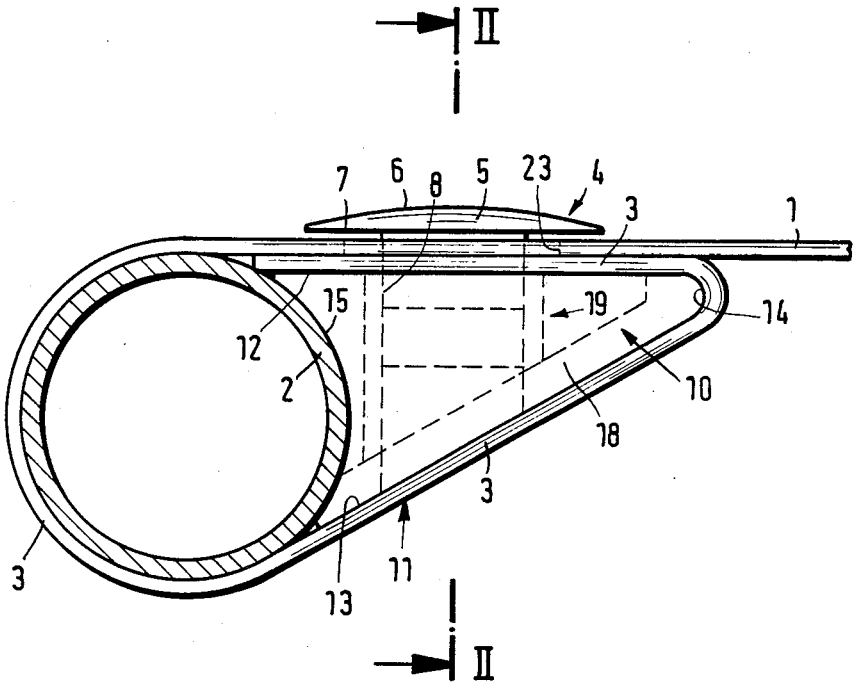
FIG. 1 is a partial lateral view of a strap with a strap end placed around a member according to a first embodiment of the invention.
Figure 2:
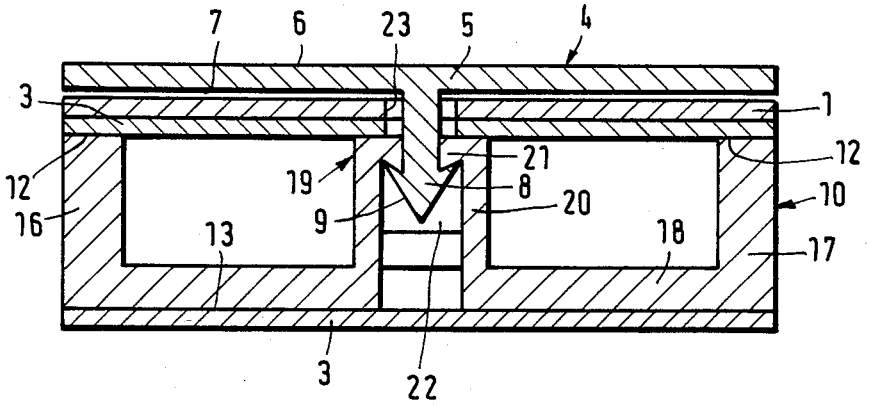
FIG. 2 is a cross-sectional view taken along line II—II in FIG. 1.

As can be initially seen in FIGS. 1 and 2, a strap, which is preferably used for the covering of furniture, consists of a flat strap piece 1 which, with its left end area, as shown in the drawing, can be placed around a frame member 2 of any suitable frame of a piece of furniture, especially furniture intended for sitting or reclining, and in which end 3 can be connected by a connecting device. The member 2 of the furniture frame is in the shape of a cylindrical tube in the illustrated embodiment, as is common for outdoor furniture for which the strap is preferably used. However, basically other cross-sectional shapes are possible as well for the member of the furniture frame like, for example, an ellipse. The not-illustrated right end of the strap piece 1 can preferably be placed around the opposite frame member in the same way using the same connecting device, the opposite frame member being located at a corresponding distance from and parallel to the first frame member.

The strap piece 1 can be made of a strip of a plastic synthetic material, a fiber-reinforced synthetic material, a textile fabric, synthetic fabrics or the like, with a strap of reinforced synthetic material or synthetic fabric being the preferred materials.

The connecting device consists of a connecting or upper part 4 in the form of a flat, plate-shaped base piece 5 which overlaps the part of the strap piece 1 on the upper side in the connection area when mounted. The base piece 5 has a level or slightly concave upper side 6 and a level lower side 7 as well as at least one locking pin 8 on its lower side, extending in a downward direction.

The base piece 5 of the upper part 4 of the connecting device preferably has a width which corresponds to the width of the strap piece 1 and preferably consists of a synthetic molded body forming one piece together with the locking pin 8 and which is made, for example, of hard PVC, poly-propylene or a similar solid synthetic material.

Locking pin 8 has a head 9 having an approximately arrow-shaped cross-sectional configuration and intended to provide a secure snap locking. More than one locking pin 8 may be used.

The connecting device additionally consists of a body member or bottom part 10 which is in the form of a wedge-shaped body filling the wedge area of loop 11 at the end of the strap. This wedge body 10 is preferably made of a synthetic molded body of a correspondingly solid material and has a width which essentially corresponds to the width of the strap end 1. The wedge body 10 has a level upper wedge area 12 about which the band strap 1 is wrapped from below in the connecting area, a level lower wedge area 13 serving as a contact area for the strap end 3, a rounded wedge area 14 facing the main part of the strap end 1, and an end face 15 which faces the member 2 and which can be placed flush to it. In the illustrated cylindrical shape of the member 2, the end face 15 is correspondingly semi-circular in cross-section. The wedge angle can be approximately 30° to 60° and is determined depending on the diameter or the measurements of the member 2 and the desired length of the wedge body 10 measured in the longitudinal direction of the strap piece 1. The length of the wedge body 10 in turn determines the lever effect which is to be produced when making the connection. This will be described in detail. The width of the wedge body 10 is preferably equal to the width of the strap piece 1 or the base piece 5.

The wedge body 10 can be in the form of a massive solid piece and correspondingly have a closed end face 15 and at least partially closed upper and lower wedge areas 12, 13. However, it can also be formed as hollow body, having closed side walls 16, 17, an essentially closed lower wall 18 forming the lower wedge area 13 and open between the side walls 16, 17 in the area of the upper wedge area 12 and the area of the end face 15. In this case, the upper wedge area 12 as well as the end face is formed merely by the narrow sides of the side walls 16, 17. By this or a similar hollow construction, the side walls 16, 17 can, for example, be arranged somewhat inwardly in a displaced fashion and the weight and the material required for the wedge body 10 is reduced, while at the same time providing sufficient stability.

On the inside, the wedge body 10 has a recess 19 for each locking pin 8. The recess 19 is formed by opposite, expanding tongues 20 separated by a slit with hook parts 21 which grasp the head 9 of the locking pin 8. The hook parts 21 are directed inwardly after the locking pin 8 has been inserted. The locking areas on the hook parts 21 and the head 9, which are thus brought into action, can be inclined in an inward direction in a slightly oblique fashion increasing the locking force with an upward lifting force on upper part 4.

The opposite, expanding tongues 20 have between them a slit-shaped intermediate area 22, and the head 9 has a corresponding dimension in a direction perpendicular to the plane in FIG. 2 so that the recess 19 forms a safety device against twisting of the locking pin 8 and thus forms the upper part 4. When the upper part 4 has two or more locking pins 8 and correspondingly the lower part 10 has several recesses 19, these parts can be approximately symmetrical in cross-section about an axis, since the twisting prevention then results from the multiplicity of the locking pins 8 and the recesses 19. The intermediate area 22 between the expanding tongues 20 of the recesses 19 preferably reaches into the lower wedge area 13 so that there is the possibility of raising these by inserting a tool, used to separate the expanding tongues 20, even when the upper and the lower parts 4, 10 have been connected. In this case, the strap end 3 would have a through opening in the area opposite to the lower opening of the intermediate area 22 in the wedge area 13 contrary to that shown in the drawing.

The wedge body 10 additionally has a fastening means for the affixing of the strap end 3 to it. In the embodiment according to FIGS. 1 and 2, this consists, for example, of an adhesive or a welding means to connect the part of the strap end 3, which overlaps the upper wedge area 12, to the upper narrow sides of the side walls 16, 17. A pin connection is an alternative which is not shown and which is preferably made in the area of the upper wedge area 12 between suitable parts of the wedge body 10 and the part of the strap end which overlaps it.

The fastening means for affixing the strap end 3 to the wedge body 10 facilitates the mounting since the strap ends 3 and wedge body 10 form a joint, managable unit. However, it is also possible not to use any special fastening means if, as shown in FIGS. 1 and 2, the strap end is guided virtually to the member 2 and overlaps the locking position. In this case, it is generally sufficient to provide the part of the strap end 3 which rests on the upper wedge area 12 with a recess through which all parts of the locking pin 8 extend when in a mounted position. Such an embodiment makes the mounting more difficult however.

The strap piece 1 has a recess 23 in a suitable position in its connection area above the wedge body 10 through which the locking pin 8 can be inserted into its recess 19. This recess is larger in the longitudinal direction of the strap 1 than the dimension of the locking pin 8 in this direction so that the strap piece 1 can be displaced in its longitudinal direction somewhat under the base piece 5 of the upper part 4. With correspondingly longitudinal strap tension, the loop 11 is pulled tightly around the wedge body 10 and the member 2 so that the strap end 3 is disposed over a clearly defined path and is rigidly affixed to the member 2 as well as to the wedge body 10. If the longitudinal tension values change in the strap piece 1 during use, the area of the strap piece 1 which is limited by base piece 5 can slip through under this in the longitudinal direction of the strap, at least to a limited extent, so that stress on the edges of the recess 23 can be prevented.

Figure 3:
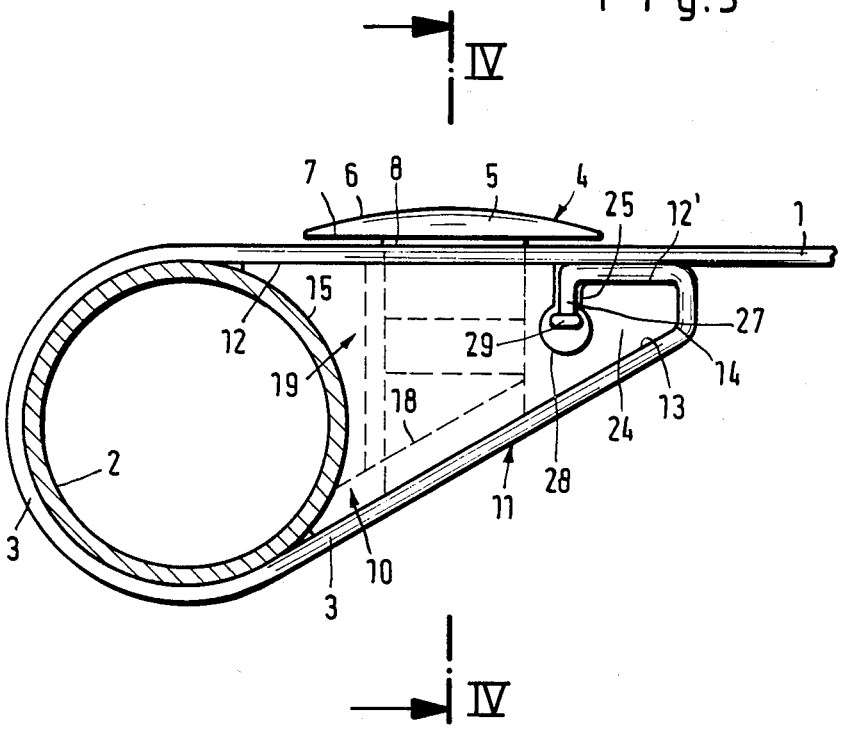
FIG. 3 is a similar view of FIG. 1 of a modification of the first embodiment.
Figure 4:
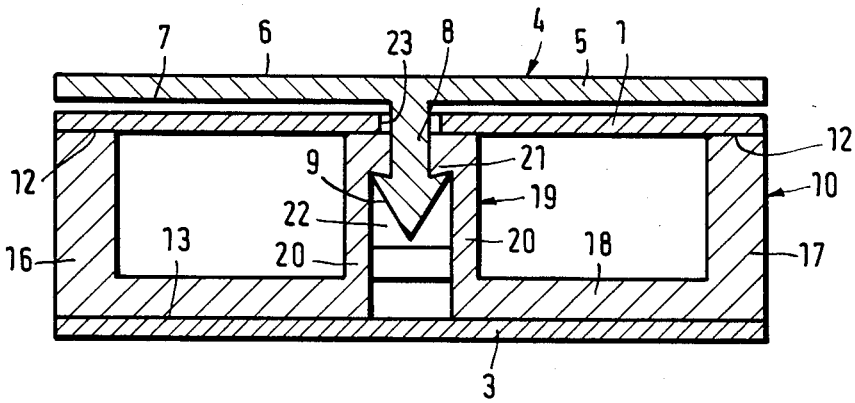
FIG. 4 is a cross-sectional view taken along line IV—IV in FIG. 3.

FIGS. 3 and 4 show an embodiment in which the wedge body 10 has a fastening transverse slit 25 in its upper wedge area 12 in the area 24 which borders the wedge edge 14 and which consists of a solid material.

The slit is intended for the mounting and affixing of the transverse edge area 27 of the strap end 3. The fastening transverse slit 25 has an inside expansion 28 which is preferably open at both ends, and a thickening 29 is provided at the transverse edge of the strap end 3 which can be laterally inserted into the expansion 28. In its capacity as a support element, the expansion 28 prevents the transverse edge areas 27 from slipping out of the fastening transverse slit 25. The thickening can be separately applied, for example, by a sprayed-on bulbous part or by a fused bulge.

In order for the strap piece 1 not to bulge in an upward direction in its connection area, the area 12' which is overlapped by strap end 3, has a wedge area 12 which is graded downwardly approximately corresponding to the thickness of the strap end 3, as shown in FIG. 3.

Figure 5:
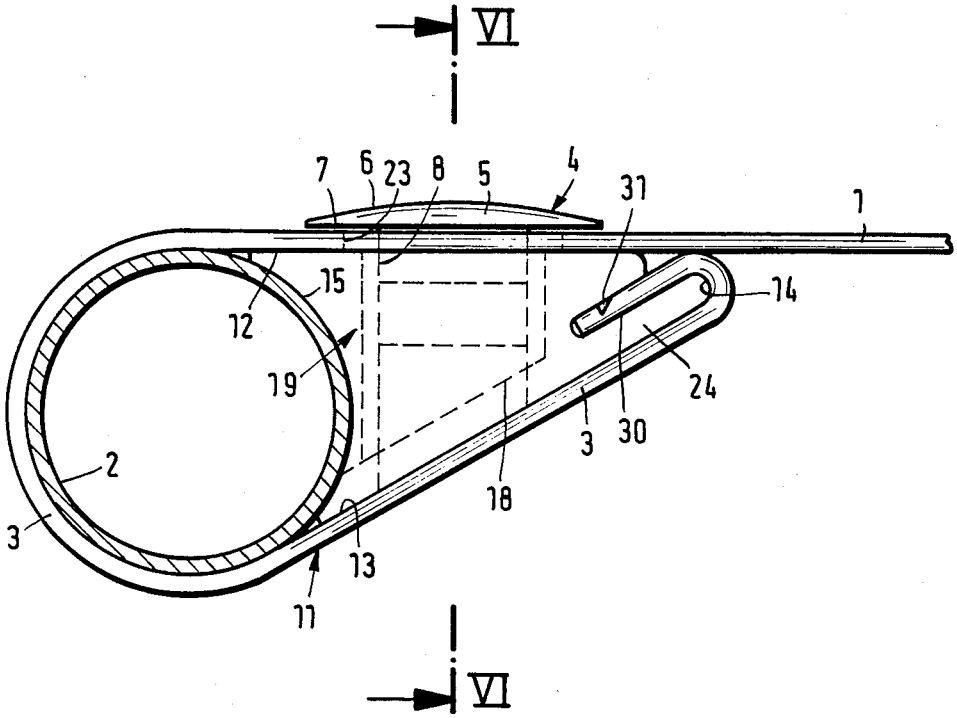
FIG. 5 is a view similar to FIG. 1 or 3 of a third embodiment.
Figure 6:
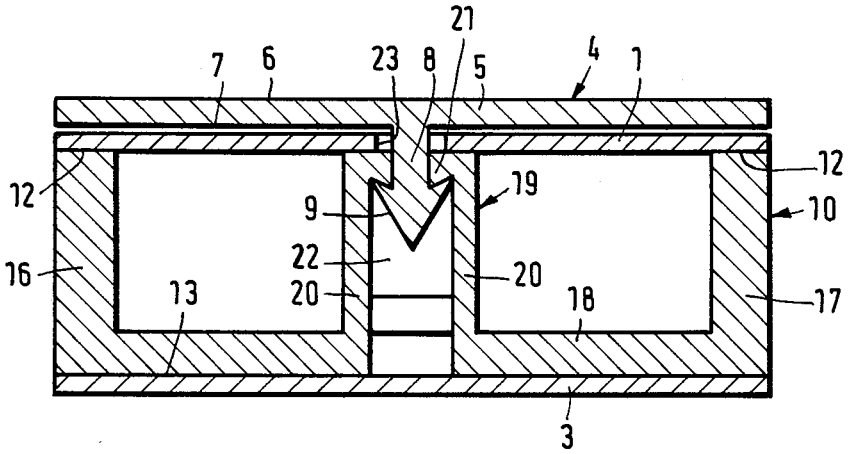
FIG. 6 is a cross-sectional view taken along line VI—VI in FIG. 5.

In the embodiment shown in FIGS. 5 and 6, the wedge body 10 has a fastening transverse slit 30 for the mounting and affixing of the transverse edge area 27 of the strap end 3 in the area of its upper wedge area 12 in the area 14 which is immediately adjacent to the wedge area 14. The fastening transverse slit 30 extends virtually parallel to the lower wedge area 13 and is formed as a clamping slit in which the transverse edge area 27 of the strap end 3 is clamped following its insertion. This fastening transverse slit 30 can also have glochidiate projections 31 which are disposed in an inward direction and which engage into the tranverse edge area 27 of the strap end 3 to thereby prevent slipping to occur.

It is self-evident that other fastening means can be used as well, for example, clamping wedges which can be inserted into a correspondingly wedge-shaped slot or the like for the transverse edge area 27 of the strap end 3 and with the strap end being affixed to the wedge body 10 by a wedge clamping effect.

Figure 7:
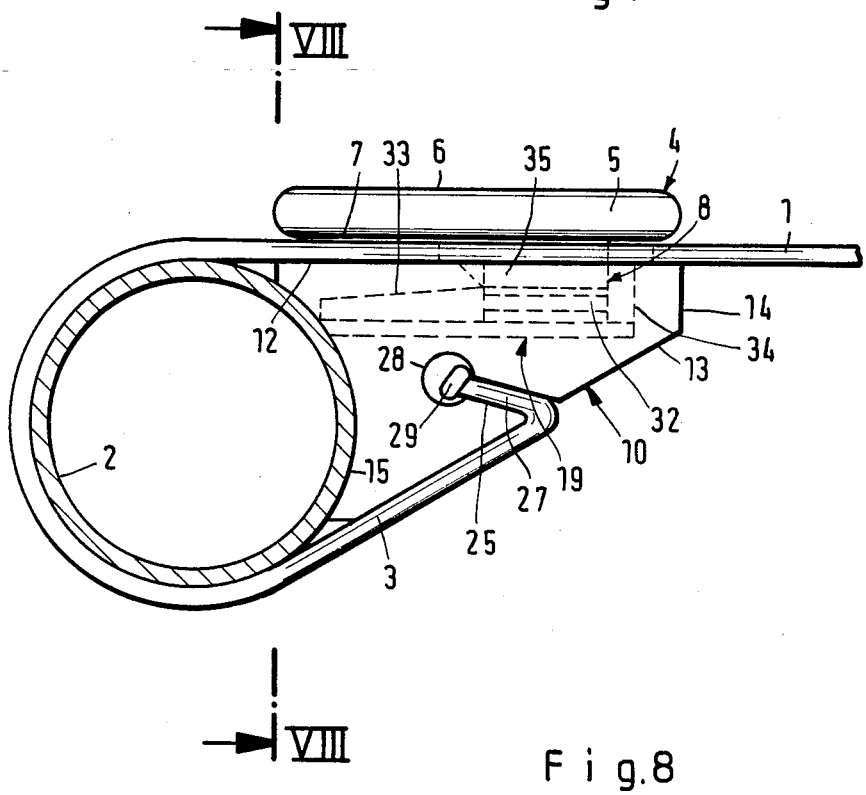
FIG. 7 is a view similar to FIG. 1 of a fourth embodimemt.
Figure 8:
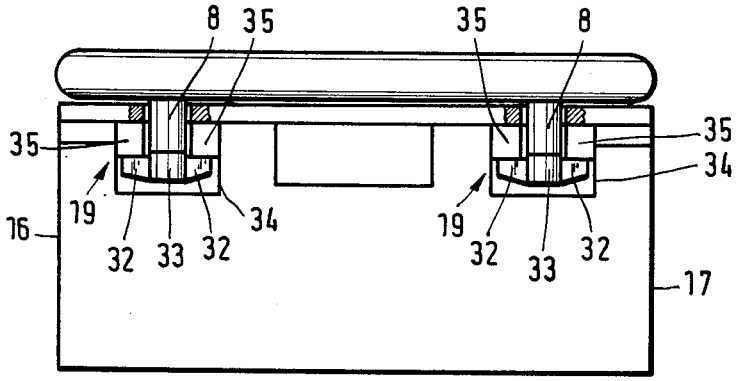
FIG. 8 is a cross-sectional view taken along line VIII—VIII in FIG. 7.

A particularly preferred embodiment is shown in FIGS. 7 and 8. Similar to the embodiment in FIG. 3, the wedge body has a fastening transverse slit 25 which, however, originates from the lower wedge area 13. A rounding of the wedge area 14 is therefore not necessary and this is instead cut off in a blunt fashion. The grading of the upper wedge area 12 can also be eliminated. An additional difference to the previous embodiments is that two locking pins 8 are provided which are formed as sliding pieces and which have a head formed by the projections 32 projecting in a transverse direction. On the side facing the member 2, the locking pin 8 has an extension 33 at the level of its head 32 which, following the insertion of locking pin 8 in the recess 19, prevents release of the recess locking.

Recess 19 for each locking pin 8 is formed as a slot 34 which is provided with recess points 35 overlapping and locking projections 32, following the insertion of the locking pins 8.

This embodiment enables the mounting of the upper part for sliding movement, as shown in FIG. 7 from left to right, which is then guided obliquely downwardly and then continued parallel to the upper side 12 until the projections 32 of the head of the locking pin 8 completely grasp the points 35 of the recess 34.

In order to fasten the strap to the member 2, the strap end 3, together with the wedge body 10 connected to it, are wrapped around the member 2 until the wedge body has reached the position shown in the drawing. Thereafter, the upper part 4 is installed and the connection completed when the locking pin 8 has reached its recess 19 in the recess base.

If the connection has to be made while producing a longitudinal strap tension in strap piece 1, as is the case when fastening the second strap end of a strap, after having already fastened the first strap end, the wedge body 10 can first be placed at the member 2 with its end face 15, whereafter the wedge body 10 is swiveled around the member 2 while exerting pressure on its lower wedge area 13 which is overlapped by the strap end 3. During this swiveling, the wedge body 10 acts as a lever reducing the pressure having to be exerted while at the same time the strap piece 1 or the strap end 3 slides around the member 2 and receives the desired longitudinal strap tension. As soon as the wedge body 10 is adjacent to the strap piece 1 with its upper wedge area 12 in the connection area, the upper part 4 can be brought between the locking pin 8 and its recess, producing the recess locking.

What is claimed:

1. A connection for connecting a strap to a frame member of an article of furniture, said frame member having at least a partial arcuate section, comprising a separable wedge-shaped body member adapted to be disposed adjacent to said frame member, said body member having a first surface and a second surface, said first and second surfaces convering toward one another to form said wedge shape, said body member also having a concave arcuate surface extending between said first and second surfaces, said concave arcuate surfaces abutting and generally conforming to said arcuate section of said frame member, said strap passing over said first surface, around at least a portion of said frame member, and on to at least a portion of said second surface such that said strap has a loop disposition extending at least partially around said frame member and said body member, a connecting member disposed over said first surface such that a portion of said strap is located between said connecting member and said body member, and securing means on said connecting member and on said body member for securing said connecting member to said body member, said securing means comprising a projecting portion on said connecting member and a receiving portion on said body member, said strap having a longitudinally extending slit through which said projecting portion passes, said strap initially being placed in said loop disposition extending at least partially around said frame member and said body member and being subsequently secured by said securing means as said projecting portion of said connecting member is received in said receiving portion of said body member, said body member being swivelable about said frame member along the respective abutting arcuate surfaces so that said body member engages said strap and and acts as a lever to apply tension to said strap prior to being secured by said securing means to thereby faciliate assembly thereof.

2. A connection according to claim 1, wherein said first and second surfaces extend at an angle of from 30 degrees to 60 degrees relative to each other.

3. A connection according to claim 1, wherein said first and second surfaces of said body member extend generally tangentially relative to said frame member.

4. A connection according to claim 1, wherein said connecting member is made of a synthetic molded material.

5. A connection according to claim 1, wherein said body member is made of a synthetic molded material.

6. A connection according to claim 1, wherein said body member has at least portions thereof which are hollow.

7. A connection according to claim 1, wherein said receiving portion on said body member opens onto said first surface of said body member.

8. A connection according to claim 1, further comprising fastening means for fastening said strap to said body member.

9. A connection according to claim 8, wherein said fastening means comprises a slot in said body member in which an end portion of said strap is received.

10. A connection according to claim 9, wherein said slot comprises a neck opening part and a bottom part, said neck opening part being narrower than said bottom part.

11. A connection according to claim 8, wherein said fastening means comprises a slot in said body member, said slot having an outside portion opening onto the outside of said body member and a juxtaposed inner portion, said inner portion being larger than said outside portion, said strap having a thickened part received in said inner portion of said slot, said thickened part of said strap being thicker than the width of the outside portion of said slot to thereby prevent said thickened part of said strap from passing through said outside portion of said slot.

12. A connection according to claim 8, wherein said slot opens onto said first surface of said body member.

13. A connection according to claim 8, wherein said slot opens onto said second surface of said body member.

14. A connection according to claim 9, wherein said end portion of said strap has barbed portions adapted to engage the walls of said slot to prevent said end portion of said strap from being pulled out of said slot.

15. A connection according to claim 1, wherein said connecting member is a flat plate-like member overlying said strap and extending substantially the width of said strap.

16. A connection according to claim 1, wherein said projecting portion comprises an external tapered wedge part, said receiving portion comprising a receiving recess having flexible wall parts adaptable to be flexibly and temporarily spread apart in order to pass said external wedge part into said receiving recess, whereby after said external tapered wedge part has passed into said receiving recess, said flexible wall parts return to their unflexed position to thereby retain said external tapered wedge part within said receiving recess.

17. A connection according to claim 9, wherein said body member has an outer end and an adjacent surface portion, said adjacent surface portion being disposed generally parallel to said first surface of said body member, said strap passing from said second surface, around said outer end, onto said adjacent surface portion and into said slot, the portion of said strap on said adjacent surface portion underlying another portion of said strap.

18. A connection according to claim 1, wherein said concave arcuate surface comprises a partial inner cylindrical surface of less than 180 degrees.

19. A connection according to claim 1, wherein said frame has a circular cross section, said first and second body member surfaces each extending generally tangentially relative to said circular cross section.

20. A connection according to claim 1, wherein said circular cross section of said frame and said concave arcuate surface have substantially the same radius.

21. A connection for connecting a strap to a frame member of an article of furniture, comprising a body member adapted to be disposed adjacent to said frame member, said body member having a first surface and a second surface, said strap passing over said first surface, around at least a portion of said frame member, and on to at least a portion of said second surface such that said strap has a loop disposition extending at least partially around said frame member and said body member, a connecting member disposed over said first surface such that a portion of said strap is located between said connecting member and said body member, and securing means on said connecting member and on said body member for securing said connecting member to said body member, said securing means comprising a projection portion on said connecting member and a receiving portion on said body member, said strap having an opening through which said projecting portion passes, said strap having a first section overlying said first surface of said body member, said opening in said strap being located in said first section of said strap, said body member having an outer end joining said first and second surfaces of said body member, said strap having a second section passing from said second surface, around said outer end and onto said first surface, said second section which is disposed on said first surface underlying said first seciton of said strap, said second section also having an opening through which said projecting portion passes, whereby said strap is adapted to be initially placed in said loop disposition extending at least partially around said frame member and said body member and subsequently secured by said securing means as said projecting portion of said connecting member is received in said receiving portion of said body member.

* * * * *